US009616319B2

(12) United States Patent
Geiges

(10) Patent No.: US 9,616,319 B2
(45) Date of Patent: Apr. 11, 2017

(54) COMPACT FOLDING BILLIARD RACK

(71) Applicant: Albert Geiges, Philadelphia, PA (US)

(72) Inventor: Albert Geiges, Philadelphia, PA (US)

( * ) Notice: Subject to any disclaimer, the term of this patent is extended or adjusted under 35 U.S.C. 154(b) by 0 days.

(21) Appl. No.: 13/789,169

(22) Filed: Mar. 7, 2013

(65) Prior Publication Data

US 2014/0256460 A1 Sep. 11, 2014

(51) Int. Cl.
*A63D 15/00* (2006.01)

(52) U.S. Cl.
CPC ..... *A63D 15/005* (2013.01)

(58) Field of Classification Search
CPC ..... A63D 15/00; A63D 15/005
USPC ..... 473/40, 41, 1, 21, 26
See application file for complete search history.

(56) References Cited

U.S. PATENT DOCUMENTS

| | | | | | |
|---|---|---|---|---|---|
| 283,732 | A * | 8/1883 | Wiggins | 473/40 | |
| 916,193 | A * | 3/1909 | Pierce | 473/40 | |
| 1,089,140 | A * | 3/1914 | Madigan | 473/40 | |
| 1,115,911 | A * | 11/1914 | Dickinson | 473/40 | |
| 1,161,324 | A * | 11/1915 | Matthay | 473/40 | |
| 1,660,626 | A * | 2/1928 | Rhoads | 473/40 | |
| 1,725,494 | A * | 8/1929 | Varnum | 473/40 | |
| 3,992,005 | A * | 11/1976 | Richey | 473/40 | |
| 4,469,328 | A * | 9/1984 | Pacitti | 473/40 | |
| 5,376,054 | A * | 12/1994 | Kwasny et al. | 473/40 | |
| D367,306 | S * | 2/1996 | Fiscella | D21/782 | |
| 5,531,646 | A * | 7/1996 | Boyle | 473/40 | |
| 5,916,032 | A * | 6/1999 | Stoll | 473/40 | |
| 6,312,342 | B1 * | 11/2001 | Newsome | 473/40 | |
| 7,166,033 | B2 * | 1/2007 | Krajeski | 473/40 | |
| 7,192,358 | B2 * | 3/2007 | Knupp | 473/40 | |
| 7,666,105 | B2 * | 2/2010 | Ball et al. | 473/40 | |
| 7,785,209 | B1 * | 8/2010 | Targosz et al. | 473/40 | |
| 8,496,535 | B2 * | 7/2013 | Kaplan | 473/40 | |
| 8,574,089 | B1 * | 11/2013 | Bova | A63D 15/005 473/40 | |
| 9,440,138 | B1 * | 9/2016 | Keyes | A63D 15/005 473/40 | |

OTHER PUBLICATIONS

The True Rack Announcement dated May 12, 2010 True Rack website product use and description dated 2012.*

* cited by examiner

*Primary Examiner* — Mitra Aryanpour
(74) *Attorney, Agent, or Firm* — Lawrence J. Shurupoff

(57) ABSTRACT

A compact folding billiard ball rack includes first and second sides coupled about a pivot portion. Each side is formed with hinge portions coupled to the pivot portion. The two sides can be pivoted or folded into a compact side by side position and into a V-shaped racking position. Magnetic latches are provided for releasably and repeatably holding the first and second sides in predetermined fixed positions.

16 Claims, 6 Drawing Sheets

COMPACT FOLDING BILLIARD RACK

BACKGROUND

Triangular racks for positioning billiard balls on a pool or billiard table have been in use for decades. Because these racks typically are produced with fixed sides, they are bulky and difficult to store and to carry from place to place. This presents a problem for some pool and billiard players.

That is, serious pool and billiard players like to use their own personal rack when competing in tournaments and other competitions around the country. The size of a conventional three-sided billiard rack requires a considerable amount of room in a cue case necessitating a cue case to be oversized and bulky.

While some billiard racks are assembled with individual sides, these racks tend to vary slightly in size and shape when assembled and reassembled. This is considered undesirable by serious or professional pool and billiard players who demand consistent precision accuracy and alignment of each and every rack of balls within a billiard ball rack.

Some billiard ball racks have movable sides which resiliently deflect around a rack of balls, while other racks have movable sides which articulate. While these racks can produce a tight rack of balls, the shape of the rack of balls is determined by the shape and arrangement of the balls, not by the fixed shape of a fixed rack. This can result in inconsistent rack configurations and alignments.

SUMMARY

This disclosure is directed to a compact foldable billiard or pool ball rack that folds and rotates from a compact storage configuration to a fixed V-shaped open ball racking position. Because of a robust precision hinged coupling, two rotating sides or arms pivot about a pivot portion into the same fixed V-shaped configuration time after time. This accurate repeatable predetermined rack configuration ensures an accurate and consistent rack time after time.

In order to eliminate any relative movement or "slop" between the movable sides of the rack when in their open position, the sides are each releasably latched and held in an accurate repeatable fixed position by a latching or locking force. In one embodiment, this force can be provided by permanent magnets. Moreover, a locking force can also be provided to securely hold the two sides together in their closed or transportable configuration. This locking force can be increased as desired by incorporating additional permanent magnets. Mechanical latches can also serve this function, such as over-center spring-biased latches.

When the sides are locked in their open position, they define an open two-sided V-shaped rack. The two sides meet and join along a horizontal hinge pin, wherein horizontal is defined by the plane of the playing surface of a pool or billiard table with the rack in its open position placed in conventional fashion for racking a rack of balls. In this case, vertical is defined as perpendicular to the playing surface.

When the sides are fixed in their open position, they define the outer limits of a rack of balls pushed securely within, between and against the sides. In order to ensure that the rack of balls is racked in the same configuration time after time solely by contact against the sides, the fixed open sides extend to an apex or end wall having a length or arc less than the diameter and profile of a conventional pool ball or billiard ball so as to "pinch" the front ball between the sides as they are racked.

With this dimensioning, the single leading ball in the rack cannot engage the end wall, but is limited in its movement toward the apex by engagement with the side walls converging toward the apex. This leaves a space between the apex or end wall of the rack and the leading ball in the rack of balls. This in turn results in other balls in the rack engaging the fixed sides and repeatably producing a rack of balls arranged in the same accurate configuration time after time.

In order to easily release the rack from an accurately positioned rack of balls, the pivot portion of the rack can be formed with a sloped or ramped undercut. This undercut allows the rack to be lifted upwardly by the free ends of the sides as the undercut portion of the pivot portion tips downwardly toward the surface of the pool or billiard table. The undercut sloping surface also reduces the weight of the rack to facilitate its proper handling and positioning and eliminates sharp vertical corners that could snag the playing surface.

In one embodiment, the compact folding billiard rack can be produced with a length of about 14 inches and a folded storage width of about two inches. This dimensioning allows the folded rack to easily and conveniently fit within the storage spaces typically available in commercially available cue cases.

Other advantages of the compact folding billiard rack include an extremely rigid but lightweight assembly having a reassuring audible "snap" or "click" providing positive notice to a player that the rack is fully latched in a predetermined position. This positive audible feedback is produced by the sides being positively driven into each other in both their open and closed latched positions by a positive biasing force produced for example, by magnetic force.

BRIEF DESCRIPTION OF THE DRAWINGS

In the various views of the drawings, like reference numerals designate like or similar parts.

DETAILED DESCRIPTION OF PREFERRED EMBODIMENTS

Figure 1:
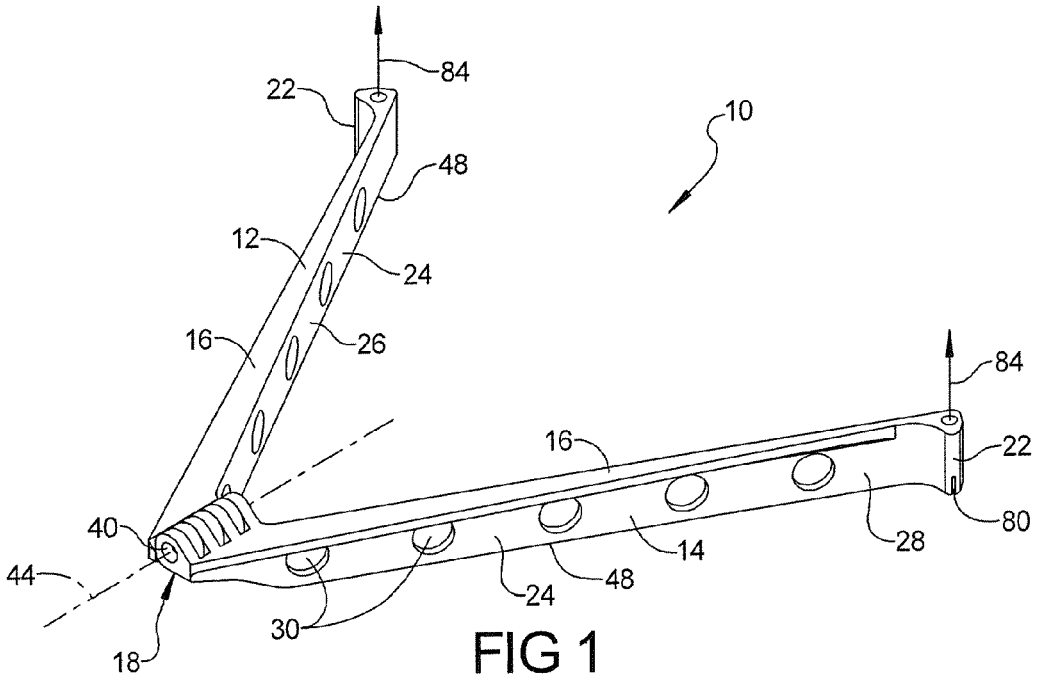
FIG. 1 is a top perspective view of a compact folding billiard ball rack constructed in accordance with this disclosure.

As seen in FIG. 1, a billiard rack 10 is shown in a fully open position defining a generally V-shaped construction. The rack 10 includes a first side or arm 12 coupled to a second side or arm 14. The two sides or arms 12, 14 can be releasably locked or latched in a predetermined open position defining an included angle of about 60 degrees.

Each side 12, 14 can be constructed of any suitable rigid material such as metal, plastic or even wood. However, a preferred metal such as aircraft aluminum has been found to be rigid and lightweight and can be accurately machined to tight tolerances.

Figure 2:
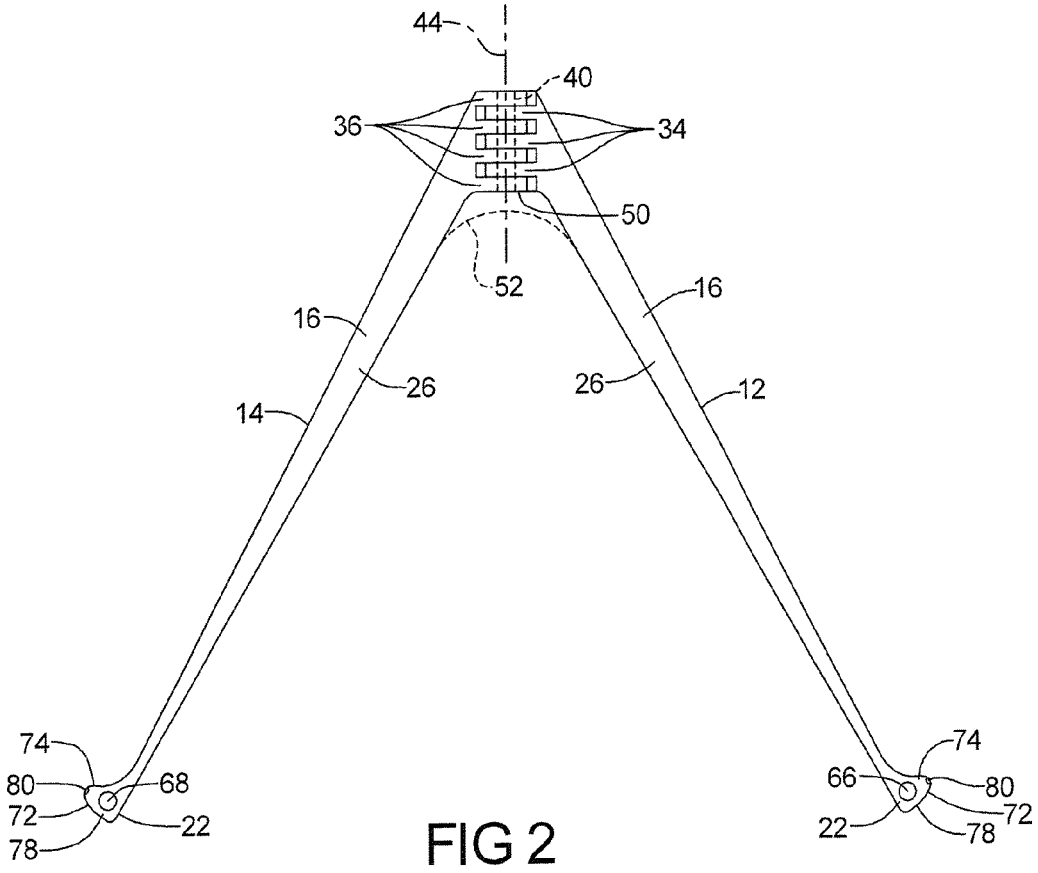
FIG. 2 is a top view of FIG. 1.

As seen in FIGS. 1 and 2, each side 12, 14 can be formed or machined with a top flange 16. Top flange 16 projects horizontally outwardly from each side 12, 14 to provide a gripping surface allowing a user to easily and conveniently lift the rack 10 upwardly from a planar surface, such as the playing surface of a billiard or pool table. The top flanges 16 also increase the strength and rigidity of each side 12, 14.

As further seen in FIGS. 1 and 2, the two top flanges 16 taper inwardly from a front pivot portion 18 rearwardly to a rear free end portion 22. Each flange 16 extends over a vertical wall 24. Each vertical wall 24 has an inner surface 26 and an outer surface 28. The weight of each wall 24 can be reduced by drilling, milling or otherwise cutting openings or holes 30 into or through each wall 24. Personally inscribed text, indicia and/or designs or inlays can be inserted within the openings 30 and/or otherwise applied to the outer surfaces 28 to distinguish and personalize a player's rack from all others.

Side 12 is formed or machined with one or more hinge fingers 34 as seen in FIG. 2. Likewise, side 14 is formed with one or more hinge fingers 36. The hinge fingers 34, 36 can be machined as flat parallel plates which are formed with a central bore for receiving a hinge pin 40 with a tight rotating friction fit. The hinge fingers 34, 36 are closely interleaved or interdigitated as shown to provide an accurate, tight pivotal coupling between the first and second sides 12, 14.

Hinge pin 40 has a central longitudinal pivot axis 44 about which the first and second sides 12, 14 pivot from a predetermined repeatable closed position to a predetermined repeatable open position and back to the same closed position time after time. The releasable fixed or latched open position and releasable fixed or latched closed positions are maintained by positive latching forces. That is, a first latch provides a positive latching force which positively holds and biases the sides 12, 14 in their closed position and a second latch provides a positive latching force which positively holds and biases the sides 12, 14 in their open position, as described further below.

Figure 13:
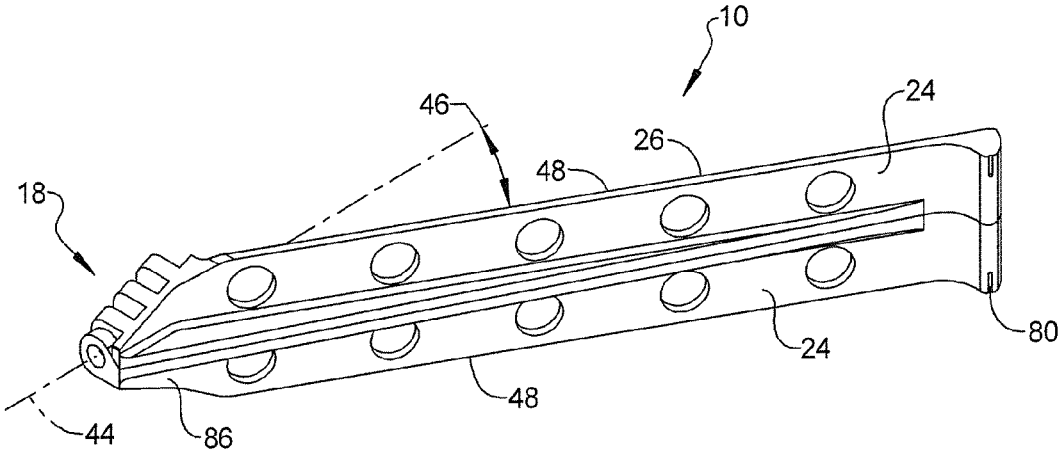
FIG. 13 is a bottom perspective view of FIG. 5.

As further seen in FIG. 1, each side 12, 14 is formed with a bottom surface 48 configured to lie in a common horizontal plane when deployed in a fully open position. Each surface 48 is configured to be positioned on a horizontal playing surface, such as the flat surface of a pool or billiard table. In this fully open position, as seen in FIG. 1, the bottom surfaces 48 lie in a plane substantially parallel to the longitudinal pivot axis 44 of the hinge pin 40. However, as seen in FIG. 13, when the rack 10 is folded or rotated into its closed position, the pivot axis 44 forms an acute angle 46 with the surfaces 48 and with the sidewalls 24 and 26. When the sides 12, 14 are fixed in this open or racking position, the pivot axis 44 substantially bisects the 60 degree angle formed between the sides 12, 14. As further seen in FIG. 2, each side 12, 14 is fixed at about a 30 degree angle with respect to the pivot axis 44.

Figure 12:
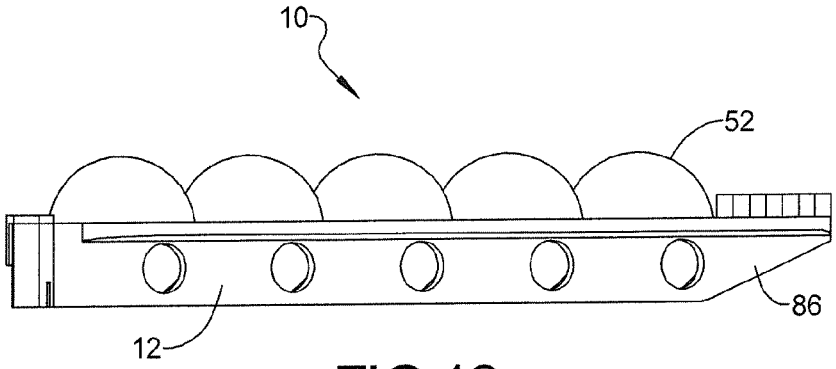
FIG. 12 is a side view of FIG. 1 holding a rack of balls.

In order to ensure that the shape of a rack of balls racked with the rack 10 is defined and fixed in the same configuration rack after rack and time after time, the inner walls 26 of the sides 12, 14 terminate at an end wall 50 that is spaced apart from the leading ball 52, as seen in FIGS. 2 and 12. In this manner, the side walls 26 engage and pinch the sides of the leading ball 52 before it can contact the end wall 50 and thereby fix the shape of the rack of balls solely along the inner walls 26. The same shape of racked balls is thereby fixed and predetermined regardless of any dimensional variations in the shape of the balls. In contrast, those racks that provide for engagement between an inner end wall or vertex and the leading edge or forwardmost point of the leading ball can allow the leading ball to contact the end wall before the sides of the leading ball engage the inner side walls of the rack. This allows for a potential loose fit or lateral clearance between the leading ball and sidewalls resulting in a variable or "sloppy" configuration in the resulting rack of balls.

To further ensure the repeatable accuracy and consistent configuration in a rack of balls, while allowing for the sides 12, 14 to pivot back and forth between open and closed positions, a positive latch is provided to hold the sides 12, 14 in the same V-shaped open racking position time after time. In one embodiment, the latch can take the form of one or more permanent magnets.

Figure 6:
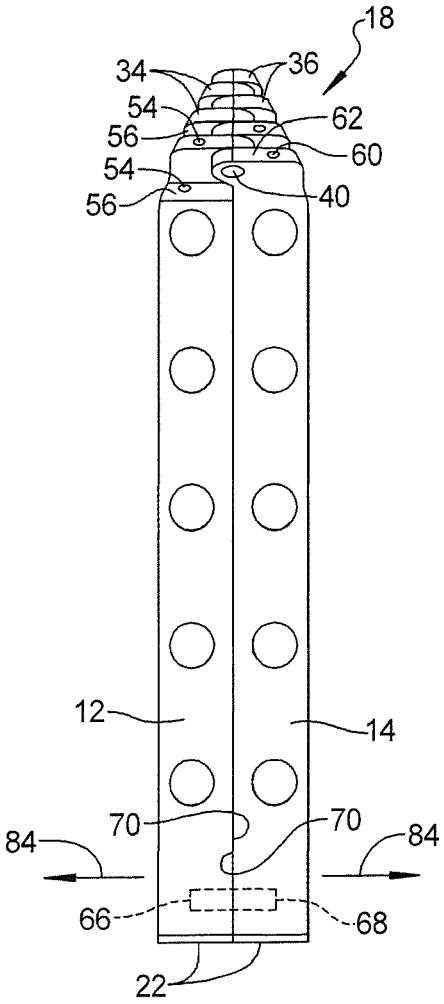
FIG. 6 is a top view of FIG. 5.

As seen in FIG. 6, a first permanent magnet 54 is press fit or bonded within a recess or bore formed in a planar engagement or abutment surface 56 in one side 12 of the pivot portion 18. A second permanent magnet 60 is likewise press fit or bonded within a recess or bore formed in a planar engagement or abutment surface 62 in the other side 14 of the pivot portion 18. These abutment surfaces can be formed on one or more of each respective hinge finger 34,36.

Planar abutment surfaces 56 and 62 are aligned with each other such that upon rotation from the closed or stored position shown in FIG. 6, to the fully open racking position shown in FIG. 2, the surfaces 56 and 62 abut one another in substantially planar contact. This abutment fixes the sides 12, 14 in their predetermined fully open racking position. At the same time, the first and second magnets 54, 60 closely confront or abut one another. The magnetic attraction between the magnets 54, 60 provides a positive latching force which securely attracts, pulls and holds the planar surfaces 56 and 62 in a releasable but predetermined latched and fixed position time after time.

As further seen in FIG. 6, to provide additional latching force to hold the sides 12,14 in their open position, additional first and second magnets 54, 60 can be respectively provided on additional abutting planar surfaces 56, 62 formed on complementary aligned abutting portions of the pivot portion 18. These planar surfaces can be located on the hinge fingers 34, 36.

When the first and second magnets 54, 56 approach each other, they pull the sides 12, 14 into their open position with a positive snap action generated by the magnetic attraction between the magnets. This produces a somewhat loud clicking or snapping sound which audibly and by tactile feel confirms to a player that the rack 10 is fixed in its proper configuration for racking a rack of balls. Latches other than magnetic latches can be used to secure the sides 12, 14 in their open position, such as spring-biased detents, over-center clasps and even frictional plug and socket connections.

The rack 10 can also be latched in its closed position, as shown in FIG. 6. Magnets 66 and 68 can be pressed into recesses or bores formed in the planar surfaces 70 of the free end portions 22 of each side 12, 14. As seen in FIG. 2, each free end portion 22 can be fanned with an enlarged bulbous projection 72 to accommodate the retention of the magnets 66, 68.

Each projection 72 is formed with a curved leading edge portion 74 and a curved trailing edge portion 78. These surfaces 74, 78 facilitate the racking of a set of balls by providing a pushing surface 78 and a pulling surface 74 allowing a player to push and pull a rack of balls into a desired position on a playing surface. The bulbous projections 72 also facilitate the gripping of the free end portions 22 to lift the rack 10 away from a rack of balls.

A rack alignment marker 80 can be provided on an outer edge portion of each free end portion 22 to assist in accurately positioning a rack of balls on a playing surface. The marker is preferably located in a position clearly visible to a player when racking a rack of balls. That is, it is preferable to position the marker 80 on the outer side or leading edge portion 74 of the free end portion 22 as opposed to the trailing edge portion 78 so that the marker 80 can be clearly illuminated by an overhead light typically located over the center of a pool or billiard table. If located on the trailing edge portion 78, the marker 80 could be obscured in a shadow cast by the end portion 22 and thus difficult to see.

The playing surface can be marked with two or more spots matching the correct position of each alignment marker 80 in the open position of the rack. By aligning the markers 80 over the spots on the table or playing surface, a rack of balls can be quickly, easily and accurately positioned time after time in the same position. The markers 80 can be formed as grooves, pockets, ribs, projections or simply provided as a spot or line of paint or tape. A colored insert such as a small insert or strip of colored plastic or light-activated glow material can also provide a highly visible marker 80.

Figure 3:
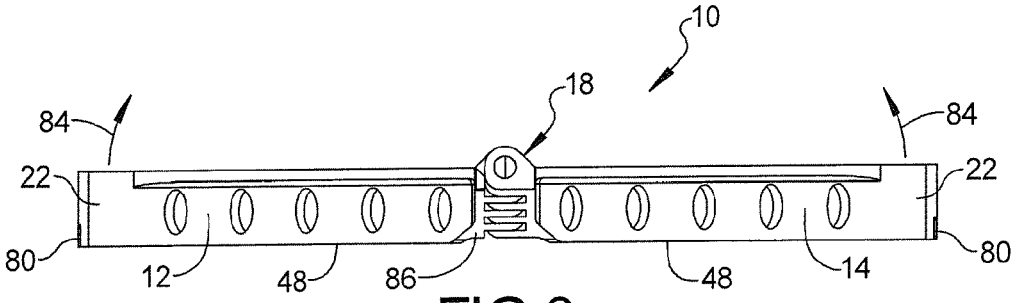
FIG. 3 is a front view of FIG. 1.
Figure 4:
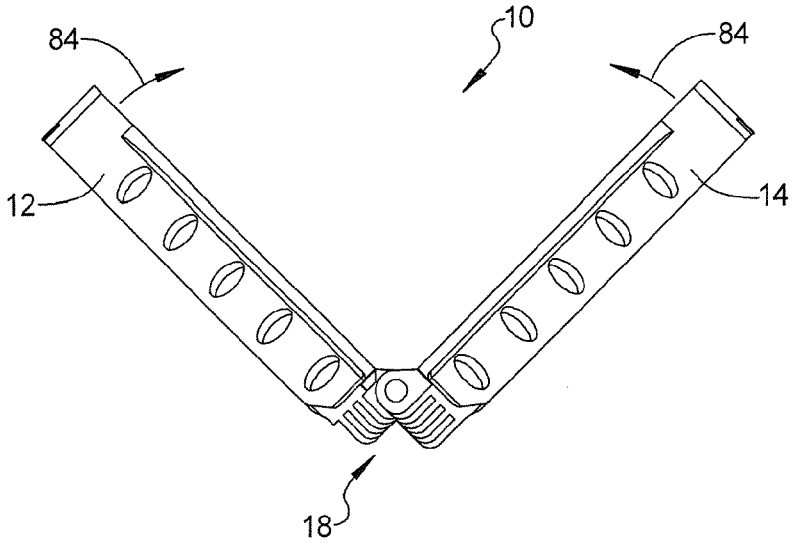
FIG. 4 is a view of FIG. 3 with the sides rotated upwardly into a partially closed position.
Figure 5:
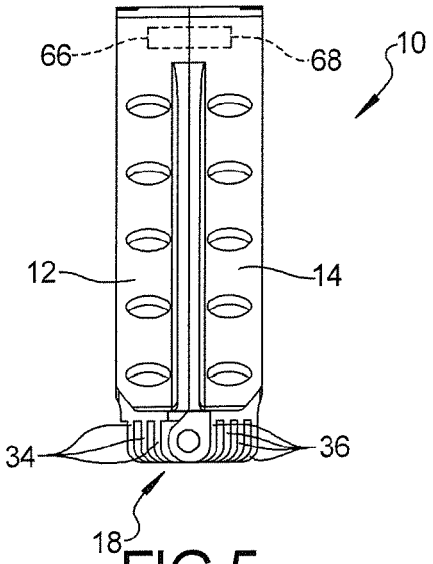
FIG. 5 is a view of FIG. 4 in a fully closed position.

FIGS. 3, 4 and 5 illustrate the manner in which the rack 10 can be folded or rotated from its fully open position in FIG. 3 to its fully closed storage position in FIG. 5. A player can grip the free end portions 22 of each side 12, 14 and apply an upward and inward twisting force as represented by directional arrows 84. When sufficient torque is applied to the sides 12, 14, the magnetic holding force of the magnetic latch provided by the magnets 54,60 is overcome and the sides 12, 14 break away from their abutment or engagement between abutment surfaces 56, 62 and begin to rotate inwardly toward each other around the pivot pin 40.

Rotation of the sides 12, 14 continues as shown in FIG. 4 until the sides 12, 14 align substantially mutually parallel along the upper planar surfaces of the top flanges 16 as the planar surfaces 70 abut each other with a positive magnetically assisted snap. The magnets 66, 68 magnetically pull and releasably lock the sides 12, 14 in a substantially parallel relationship as shown in FIG. 5.

Figure 7:
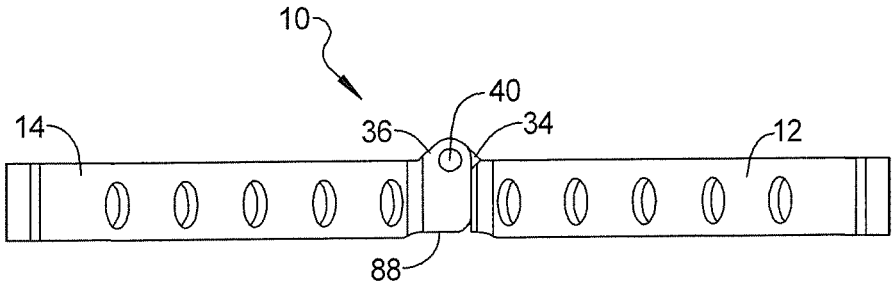
FIG. 7 is a rear view of FIG. 3.
Figure 8:
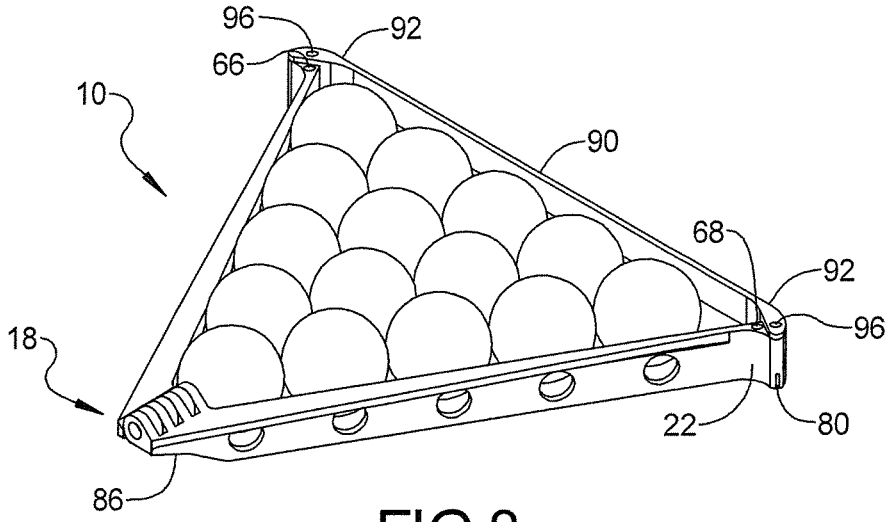
FIG. 8 is a perspective view of an alternate embodiment.

As further seen in FIGS. 3, 8 and 12, the pivot portion 18 overlies an upwardly and forwardly sloped planar undercut surface portion 86. A view of the undercut surface portion 86 is further shown in a closed position in FIG. 13. This undercut portion 86 reduces the weight of the rack 10 and facilitates the forward sliding motion of the rack 10 as it is pushed forwardly. That is, the sloped surface eliminates sharp forward edges and will not dig into a playing surface as the rack 10 moves forwardly over the playing surface. As seen in FIG. 7, the bottom of the undercut portion 86 is recessed above the playing surface along a bridge portion 88 to further prevent sliding drag and snagging.

Figure 9:
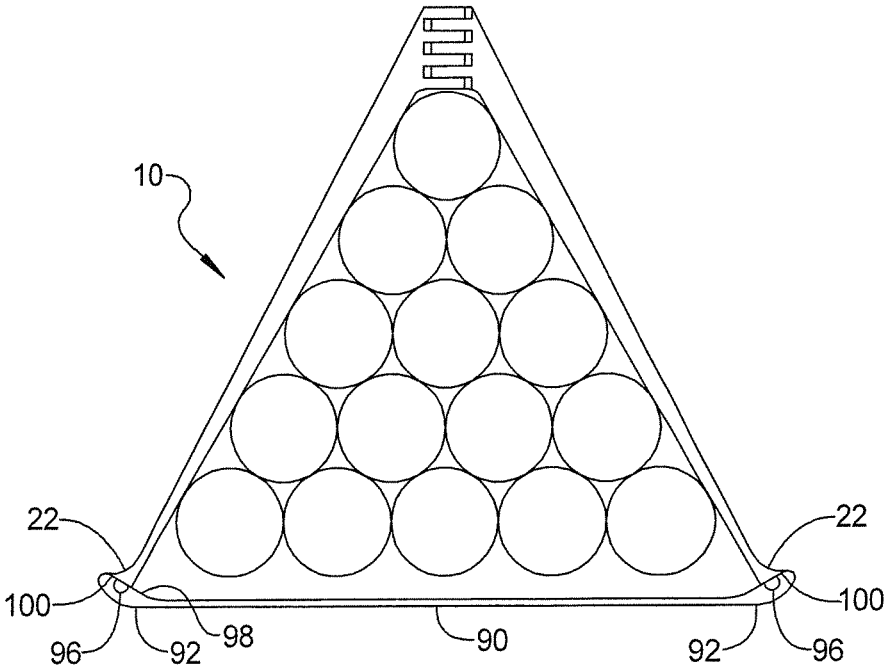
FIG. 9 is a top view of FIG. 8.

An alternate embodiment of the rack 10 is depicted in FIGS. 8 and 9 wherein a detachable rear push bar 90 is removably attached to the free end portions 22 of each side 12,14. Push bar 90 can be formed of virtually any rigid material, however, to reduce weight, an aluminum material serves well. The push bar 90 is provided with a recess or bore in each of its end portions 92 for receiving a permanent magnet 96.

In those cases where it is desired to use a three sided rack, the push bar 90 can be quickly and easily attached to the V-shaped open rack 10 by aligning each end portion 92 of the push bar 90 with a mating free end portion 22 so that the magnets 96 on the push bar 90 align juxtaposed to the magnets 66, 68 embedded or otherwise carried on the end portions 22 of the sides 12, 14. As the magnets 96 on the push bar 90 approach the magnets 66, 68 on the free end portions 22 of the sides 12, 14, the push bar 90 snaps into a predetermined position on the free end portions 22. The abutting surfaces between the push bar 90 and the free end portions 22 are formed with complementary keyed or matched planar surfaces to guide and locate the push bar 90 in the same position on the rack 10 each time the push bar is attached to the rack 10.

In the embodiment shown in FIGS. 8 and 9, it is desirable to provide complementary planar mating surfaces 98, 100 on the respective free ends 92 of the push bar 90 and the free end portions 22. To remove the push bar 90 from the sides 12, 14, a player simply pulls the push bar 90 away from the free ends 22 until the magnetic holding force of the magnetic latch provided by the magnets 66, 68 and 96 is overcome.

Figure 10:
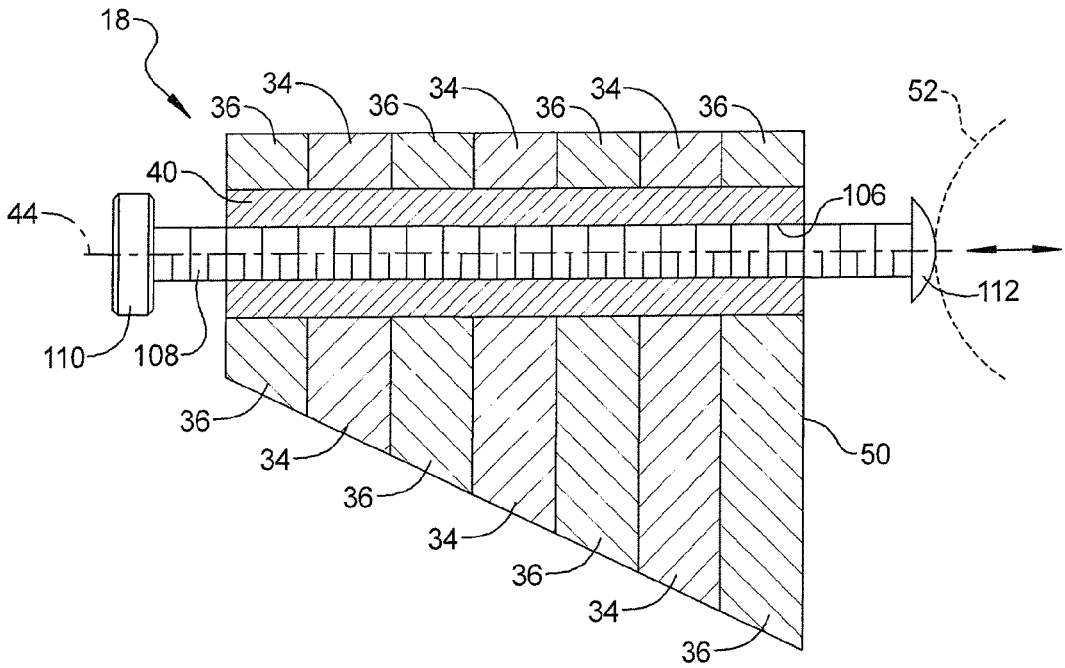
FIG. 10 is a view in axial section of an alternate embodiment of a pivot portion.

In some cases, it may be desirable to tighten up a rack of balls held within the rack 10. A rack of balls can be "snugged up" with the adjustment arrangement shown in FIG. 10. In this embodiment, the hinge pin 40 is formed with a central threaded bore 106 which receives a threaded adjustment rod 108. A knurled head 110 is provided on the forward end of the rod 108 and a bumper cap 112 is provided on the rearward end of the rod 108.

By turning the head 110, the adjustment rod 108 can be precisely moved forwardly and rearwardly to advance or retract the bumper cap with respect to the leading ball 52 held in a rack of balls. The leading ball 52 can be accurately positioned between the sides 12, 14 by pressure applied to it by the bumper cap 112.

Figure 11:
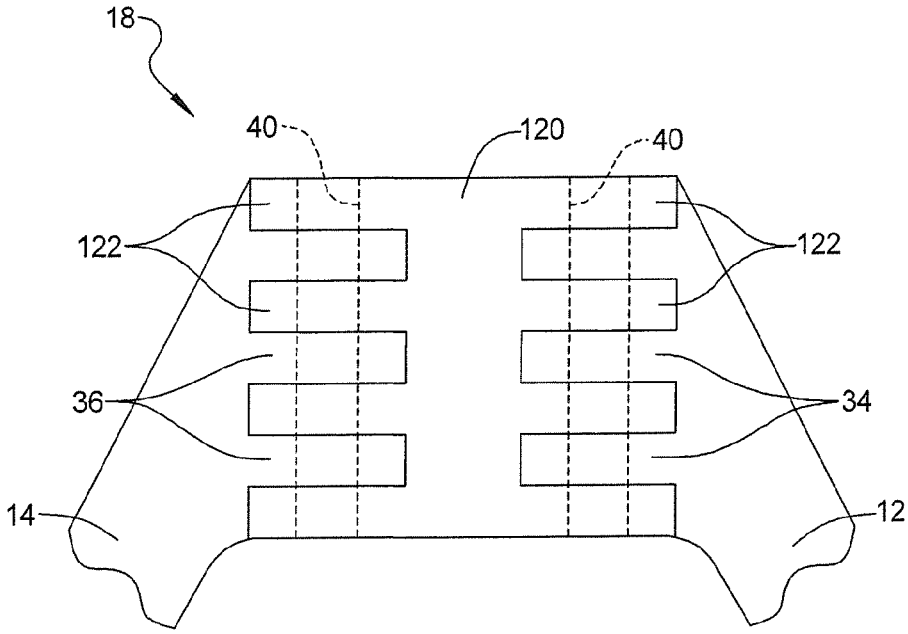
FIG. 11 is a partial view of an alternate embodiment of a pivot portion having two pivot pins.

While this disclosure is made in terms of representative embodiments, it is not intended to be so limited. Other variations are intended to be included within the scope of the appended claims. For example, while only a single hinge pin 40 has been described above, it is within the scope of this disclosure to provide, such as shown in FIG. 11, a central hinge body 120 in the pivot portion 18 for receiving two hinge pins 40 as shown in dashed lines. The hinge body 112 includes one or more hinge fingers 122 extending laterally on each side. Each hinge finger can be formed as a planar plate formed with a central bore for receiving a hinge pin 40 in the manner described above. In this case, each side 12,14 is formed with complementary hinge fingers 34,36 each having a central bore for receiving a respective hinge pin 40. The hinge fingers 122 on the central hinge body and the hinge fingers 34,36 on the sides 12,14 are closely and tightly interleaved or interdigitated as described above.

There has been disclosed heretofore the best embodiment of the disclosure presently contemplated. However, it is to be understood that various changes and modifications may be made thereto without departing from the spirit of this disclosure.

What is claimed is:

1. A two sided ball having only two sides, comprising:

a first side of said only two sides having a front end portion, a rear free end portion and a bottom surface portion, said front end portion of said first side comprising an abutment surface;

a second side of said only two sides having a front end portion, a rear free end portion and a bottom surface portion, said front end portion of said second side comprising an abutment surface;

a pivot portion pivoting around a pivot axis and coupling said front end portions of said first and second sides, said first and second sides pivoting around said pivot axis from a predetermined repeatable closed position with said first and second sides aligned side by side with each other to a predetermined repeatable open position with said abutment surfaces pivoted into contacting abutment defining a releasable fixed open V-shaped configuration with an included angle of about 60 degrees; and said pivot portion comprising a plurality of hinge fingers each having a bore formed therethrough and a pivot pin extending through each bore, said plurality of hinge fingers comprising a plurality of closely interleaved flat parallel plates rotating around said pivot pin with a tight rotating fit and providing an accurate, tight pivotal coupling between said first and second sides.

2. The rack of claim 1, wherein said first and second bottom surface portions are designed and constructed to lie horizontally on a horizontal playing surface.

3. The rack of claim 1, further comprising a comprising a magnetic latch releasably holding said first and second sides in said closed position with an audible magnetically driven snap action.

4. The rack of claim 1, wherein said first and second sides abut and contact each other in substantially planar contact.

5. The rack of claim 1, further comprising a magnetic latch releasably holding said first and second sides in said V-shaped configuration an audible magnetically driven snap action.

6. The rack of claim 1, wherein said front end portions of said first and second sides abut and contact each other in said open V-shaped configuration with an audible snap action.

7. A ball rack pivotable into an open V-shaped configuration from closed folded configuration, comprising:

a first side having a first bottom surface portion and a plurality of first hinge fingers;

a second side having a second bottom surface portion and a plurality of second hinge fingers;

a pivot pin pivotally coupling said first and second sides, said pivot pin having a longitudinal axis;

said first and second bottom surface portions lie in a common plane extending substantially parallel to said longitudinal axis when said first and second sides are pivoted into said V-shape configuration; and an adjustment rod extending axially through said pivot pin for engaging a racked ball.

8. The rack of claim 7, further comprising a first latch provided on each of said first and second sides and releasably latching said first and second sides in a closed storage position.

9. The rack of claim 7, further comprising a second latch provided on each of said first and second sides and releasably latching said first and second sides in said open V-shaped position.

10. The rack of claim 7, wherein said first and second sides are arranged in a substantially mutually parallel configuration when pivoted into a closed folded position.

11. A two sided ball rack having only two sides pivoting from a closed side by side position to an open V-shaped configuration for a placement on a horizontal playing surface, comprising:

a first side having a first bottom surface portion configured to be positioned on said horizontal playing surface;

a second side having a second bottom surface portion configured to be positioned on said horizontal playing surface;

a pivot portion coupling said first and second sides and comprising a pivot pin having a pivot axis extending in a plane substantially parallel to said first and second bottom surface portions when said first and second bottom surface portions are positioned on said horizontal playing surface and said pivot axis extending at an acute angle with said first and second sides when said first and second sides are positioned in said closed side by side position, said pivot portion further comprising a plurality of hinge fingers each having a bore formed therethrough and said pivot pin extending through each bore, said plurality of hinge fingers comprising a plurality of closely interleaved flat parallel plates rotating around said pivot pin with a tight rotating fit and providing an accurate, tight pivotal coupling between said first and second sides; and a latch provided on said pivot portion releasably holding said first and second sides in said open V-shaped configuration with an included angle of about 60 degrees between said first and second sides.

12. The rack of claim 11, wherein said first and second bottom surface portions lie in a plane substantially parallel to said pivot axis in open V-shaped configuration.

13. A two sided ball rack having only two sides, comprising:

a first side having a front end portion, a rear end portion, a top surface portion and a bottom surface portion, an abutment portion and a side wall between said top and bottom surface portions of said first side;

a second side having a front end portion, a rear end portion, a top surface portion and a bottom surface portion, an abutment and a side wall between said top and bottom surface portions of said second said; and a pivot portion coupling said front end portions for rotation of said first and second sides about a pivot axis from a fully open position to a fully closed position, said pivot portion comprising a plurality of hinge fingers each having a bore formed therethrough and a pivot pin extending through each bore, said plurality of hinge fingers comprising a plurality of closely interleaved flat parallel plates rotating around said pivot pin with a tight rotating fit and providing an accurate, tight pivotal coupling between said first and second sides.

14. The ball rack of claim 13, wherein said first and second abutment portions abut and contact each other on said pivot portion in fully open position to limit opening movement between said first and second sides, and said pivot axis extends at an acute angle to said side walls in said fully closed position.

15. The ball rack of claim 13, wherein said first and second sides comprise latches releasably latching said first and second sides in said fully open and fully closed positions.

16. The ball rack of claim 15, wherein said latches comprise snap action magnetic latches.

* * * * *